US010401083B2

(12) United States Patent
Lochner et al.

(10) Patent No.: US 10,401,083 B2
(45) Date of Patent: Sep. 3, 2019

(54) PLANT FOR PRODUCING OXYGEN BY CRYOGENIC AIR SEPARATIN

(71) Applicant: LINDE AKTIENGESELLSCHAFT, Munich (DE)

(72) Inventors: Stefan Lochner, Grafing (DE); Thomas Nohlen, Germering (DE); Lars Kirchner, Dresden (DE); Dimitri Golubev, Geretsried (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/556,364

(22) PCT Filed: Mar. 10, 2016

(86) PCT No.: PCT/EP2016/000431

§ 371 (c)(1),
(2) Date: Sep. 7, 2017

(87) PCT Pub. No.: WO2016/146246

PCT Pub. Date: Sep. 22, 2016

(65) Prior Publication Data

US 2018/0038645 A1 Feb. 8, 2018

(30) Foreign Application Priority Data

Mar. 13, 2015 (EP) ..... 15000746

(51) Int. Cl.
*F25J 3/04* (2006.01)

(52) U.S. Cl.
CPC ..... *F25J 3/04715* (2013.01); *F25J 3/0409* (2013.01); *F25J 3/04084* (2013.01);
(Continued)

(58) Field of Classification Search
CPC .. F25J 3/04715; F25J 3/04709; F25J 3/04678; F25J 3/04448; F25J 3/04412;
(Continued)

(56) References Cited

U.S. PATENT DOCUMENTS 5,233,838 A * 8/1993 Howard ..... F25J 3/042 62/646
2001/0052243 A1* 12/2001 Davidian ..... F25J 3/04018 62/643

(Continued)

FOREIGN PATENT DOCUMENTS

| | | |
|---|---|---|
| DE | 10 2009 023900 A1 | 12/2010 |
| EP | 1 108 965 A1 | 6/2001 |
| JP | S57 60166 | 4/1982 |

OTHER PUBLICATIONS

International Search Report for PCT/EP2016/000431, dated Jun. 9, 2016, Authorized Officer: Dirk Goritz, 3 pages.

(Continued)

*Primary Examiner* — Emmanuel E Duke
(74) *Attorney, Agent, or Firm* — Millen White Zelano & Branigan, PC

(57) ABSTRACT

The plant is used for producing oxygen by cryogenic air separation. The plant has a high-pressure column, a low-pressure column and a main condenser. An argon-elimination column is in fluid connection with an intermediate point of the low-pressure column and is connected to an argon-elimination column head condenser. An auxiliary column has a sump region, into which gas is introduced from the argon-elimination column head condenser. The head of the auxiliary column is connected to a return flow liquid line, in order to introduce a liquid stream from the high-pressure column or the head condenser. The liquid stream has an oxygen content which is at least equal to that of air. At least one part of the crude liquid oxygen from the sump of the high-pressure column is fed to the auxiliary column at a first intermediate point.

18 Claims, 8 Drawing Sheets

(52) U.S. Cl.
CPC ..... *F25J 3/04296* (2013.01); *F25J 3/04303* (2013.01); *F25J 3/04393* (2013.01); *F25J 3/04412* (2013.01); *F25J 3/04448* (2013.01); *F25J 3/04678* (2013.01); *F25J 3/04709* (2013.01); *F25J 3/04872* (2013.01); *F25J 3/04878* (2013.01); *F25J 3/04896* (2013.01); *F25J 3/04909* (2013.01); *F25J 3/04939* (2013.01); *F25J 3/04157* (2013.01); *F25J 3/04181* (2013.01); *F25J 2200/06* (2013.01); *F25J 2200/08* (2013.01); *F25J 2200/32* (2013.01); *F25J 2200/78* (2013.01); *F25J 2205/30* (2013.01); *F25J 2235/50* (2013.01); *F25J 2245/50* (2013.01); *F25J 2245/58* (2013.01); *F25J 2250/02* (2013.01); *F25J 2250/10* (2013.01); *F25J 2290/12* (2013.01)

(58) Field of Classification Search
CPC .. F25J 3/04393; F25J 3/04303; F25J 3/04296; F25J 3/0409; F25J 3/04084; F25J 3/04939; F25J 3/04909; F25J 3/04878; F25J 3/04872; F25J 2290/12; F25J 2200/78; F25J 2235/50; F25J 2245/50; F25J 3/04157; F25J 3/04181; F25J 2250/02; F25J 2245/58; F25J 2205/30; F25J 2200/32; F25J 2200/08; F25J 2200/06; F25J 2250/10
See application file for complete search history.

(56) References Cited

U.S. PATENT DOCUMENTS

2002/0178747 A1 12/2002 Pompl
2011/0138856 A1 6/2011 Howard et al.

OTHER PUBLICATIONS

"Dual LP Column with Argon", IP.com Journal, Nov. 24, 2008, 4 pages, IP.com No. I PCOM000176762D.
Rodney J. Allam, "Improved oxygen production technologies", Science Direct Energy Procedia 1 (2009) pp. 461-470, Elsevier.

* cited by examiner

LOX
LIN 38
138a
25
36
138b
136a
37
136b
108
108a
140
108b
17
34
18
31
16
141
3
32
33
28
11
10
23
7
12
9
2
35
1
13
39
6
14
5
4
22
15
24
21
20
26

LOX
LIN
38
138a
25
36
138b
136a
37
136b
108
108b
108a
140
150
151
A3
16
17
18
34
141
3
32
30
33
28
31
A2
11
10
23
29
7
12
9
2
35
1
A1
13
39
6
14
5
4
22
15
24
21
20
26

PLANT FOR PRODUCING OXYGEN BY CRYOGENIC AIR SEPARATION

CROSS-REFERENCE TO RELATED APPLICATIONS

This application claims priority under 35 USC § 119 to International Patent Application No. PCT/EP2016/000431, filed on Mar. 10, 2016 which claims priority from European Patent Application EP 15 000 746.6, filed on Mar. 13, 2015.

BACKGROUND OF THE INVENTION

The invention relates to a method for producing oxygen by low-temperature separation of air in a distillation column system which comprises a high-pressure column and a low-pressure column; a main condenser which is configured as a condenser evaporator, wherein the liquefaction space of the main condenser is in fluid communication with the top of the high-pressure column and the evaporation space of the main condenser is in fluid communication with the low-pressure column; an argon discharge column which is in fluid communication with an intermediate point on the low-pressure column; an argon discharge column tops condenser which is configured as a condenser-evaporator, wherein the liquefaction space of the argon discharge column tops condenser is in fluid communication with the top of the argon discharge column; an auxiliary column whose bottom region is configured for introduction of gas from the evaporation space of the argon discharge column tops condenser; wherein liquid crude oxygen from the bottom of the high-pressure column is introduced into the auxiliary column; a liquid stream from the high-pressure column or the main condenser is introduced as reflux onto the too of the auxiliary column via a reflux liquid conduit, wherein the liquid stream has a nitrogen content at least equal to that of air.

The principles of low-temperature separation of air generally and the construction of two-column plants specifically are described in the monograph "Tieftemperaturtechnik" [low-temperature technology] by Hausen/Linde (2nd Edition, 1985) and in an article by Latimer in Chemical Engineering Progress (Vol. 63, No. 2, 1967, page 35). The heat-exchanging relationship between the high-pressure column and the low-pressure column of a double column is generally realized by way of a main condenser, in which tops gas from the high-pressure column is liquefied against evaporating bottoms liquid from the low-pressure column.

The distillation column system of the invention may in principle be configured as a classical two-column system having a high-pressure column and a low-pressure column. In addition to the two separating columns for nitrogen-oxygen separation it may comprise further apparatuses for obtaining other air components, in particular noble gases, for example a krypton-xenon obtaining operation.

An "argon discharge column" refers here to a separating column for argon-oxygen separation which does not serve to obtain a pure argon product, but serves to discharge argon from the air to be fractionated in the high-pressure column and the low-pressure column. Its interconnection differs only slightly from that of a classical crude argon column but it contains far fewer theoretical plates, namely fewer than 40, in particular between 15 and 30. Similarly to a crude argon column, the bottom region of an argon discharge column is connected to an intermediate point on the low-pressure column and the argon discharge column is cooled by a tops condenser on the evaporation side of which decompressed bottoms liquid from the high-pressure column is introduced; an argon discharge column does not comprise a bottoms evaporator.

In the invention the main condenser and the argon discharge column tops condenser are configured as condenser-evaporators. The expression "condenser-evaporator" refers to a heat exchanger in which a first, condensing fluid stream enters into indirect heat exchange with a second, evaporating fluid stream. Each condenser-evaporator has a liquefaction space and an evaporation space, which consist of liquefaction passages and evaporation passages respectively. The condensation (liquefaction) of the first fluid stream takes place in the liquefaction space, the evaporation of the second fluid stream in the evaporation space. The evaporation space and the liquefaction space are formed by groups of passages which are in a heat-exchanging interrelationship.

The main condenser may be configured as a single- or multi-level bath evaporator, in particular as a cascade evaporator (as is described in EP 1287302 B1=U.S. Pat. No. 6,748,763 B2 for example) or else as a falling film evaporator. Said condenser may be formed by a single heat-exchanger block or else by a plurality of heat-exchanger blocks arranged in a common pressure vessel.

The distillation column system of an air separation plant is arranged in one or more cold boxes. A "cold box" is herein to be understood as meaning an insulating encasement which completely encompasses a thermally insulated interior with outer walls; plant parts to be insulated, for example one or more separation columns and/or heat exchangers, are arranged in the interior. The insulating effect may be brought about through appropriate configuration of the outer walls and/or by filling the interspace between plant parts and outer walls with an insulating material. The latter version preferably employs a pulverulent material such as perlite for example. Not only the distillation column system for nitrogen-oxygen separation in a low-temperature air separation plant but also the main heat exchanger and further cold plant parts have to be enclosed by one or more cold boxes. The external dimensions of the cold box typically determine the in-transit dimensions for prefabricated plants.

A "main heat exchanger" serves to cool feed air in indirect heat exchange with return streams from the distillation column system. Said heat exchanger can be formed from a single heat exchanger section or a plurality of parallel and/or serially connected heat exchanger sections, for example from one or more plate heat exchanger blocks. Separate heat exchangers used specifically for evaporation or pseudo-evaporation of a single liquid or supercritical fluid without heating and/or evaporation of a further fluid do not belong to the main heat exchanger.

The relative spatial terms "top", "bottom", "over", "under", "above", "below", "next to", "side by side", "vertical", "horizontal", etc. relate to the spatial alignment of the separation columns in normal operation. An arrangement of two columns or apparatus parts "one above the other" is understood here to mean that the upper end of the lower of the two apparatus parts is situated at lower or identical geodetic height as the lower end of the upper of the two apparatus parts and the projections of the two apparatus parts in a horizontal plane overlap. In particular, the two apparatus parts are arranged exactly one above the other, i.e. the axes of the two columns proceed on the same vertical straight line.

A method of the type specified at the outset and a corresponding plant are known from IPCOM000176762D. Depicted therein in FIG. 3 is an air separation plant comprising a double column composed of a high-pressure column and low pressure columns comprising an argon column and an auxiliary column arranged thereover. The auxiliary column serves to disburden the low-pressure column and is accordingly operated at the same pressure as the corresponding section of the low-pressure column. Gas from the low-pressure column is introduced at the bottom of the auxiliary column.

The invention has for its object to make the method of the type specified at the outset and a corresponding plant more energy-efficient. It relates in particular to air separation plants of particularly large capacity, in particular for obtaining oxygen. Such plants in particular are configured for an air rate of more than 370 000 $Nm^3/h$, preferably more than 1 000 000 $Nm^3/h$.

SUMMARY OF THE INVENTION

This object is achieved by a method for producing oxygen by low-temperature separation of air in a distillation column system which comprises a high-pressure column and a low-pressure column; a main condenser which is configured as a condenser evaporator, wherein the liquefaction space of the main condenser is in fluid communication with the top of the high-pressure column and the evaporation space of the main condenser is in fluid communication with the low-pressure column; an argon discharge column which is in fluid communication with an intermediate point on the low-pressure column; an argon discharge column tops condenser which is configured as a condenser-evaporator, wherein the liquefaction space of the argon discharge column tops condenser is in fluid communication with the top of the argon discharge column; an auxiliary column whose bottom region is configured for introduction of gas from the evaporation space of the argon discharge column tops condenser; wherein liquid crude oxygen from the bottom of the high-pressure column is introduced into the auxiliary column; a liquid stream from the high-pressure column or the main condenser is introduced as reflux onto the top of the auxiliary column via a reflux liquid conduit, wherein the liquid stream has a nitrogen content at least equal to that of air characterized in that at least a first portion of the liquid crude oxygen is supplied to the auxiliary column at a first intermediate point; at the top the auxiliary column is operated at a pressure which is at least 50 mbar higher than the operating pressure at the too of the low-pressure column.

In the invention the crude oxygen from the high-pressure column is not passed or not fully passed into the evaporation space of the argon condenser but at least a portion, in particular more than 10%, preferably more than 20% is supplied to the auxiliary column at an intermediate point, i.e. above at least one mass transfer section.

The operating pressure at the top of the auxiliary column is at least 50 mbar greater than that at the top of the low-pressure column. The pressure difference is for example 50 to 200 mbar, preferably 50 to 150 mbar. As a result, the nitrogen product from the top of the auxiliary column even then has sufficient pressure to be able to serve as regeneration gas for the air purification. The pressure at the top of the low-pressure column can therefore be extremely low. However, said pressure determines via the main condenser (approximately factor of 3) and the high-pressure column the feed air pressure to which the entirety of the feed air needs to be compressed. A pressure reducing means at the top of the low-pressure column results in a markedly higher reduction in the high-pressure column pressure of about 200 to 300 mbar and thus in a considerable energy-saving in the compression of the feed air.

In the auxiliary column the evaporated fraction from the argon discharge column tops condenser (oxygen content typically about 32 to 40 mol %) is rectified outside the low-pressure column. Thus, a portion of the nitrogen-oxygen separation is no longer performed in the relevant section of the low-pressure column and the low-pressure column is correspondingly disburdened. Conversely at virtually identical diameter and length of the low-pressure column, the capacity can be correspondingly increased and a greater amount of oxygen obtained in the plant as a whole. In principle, the entirety of the gas from the evaporation space of the argon discharge column tops condenser may be introduced into the auxiliary column and rectified therein. However, it is possible to introduce only a portion of this gas into the auxiliary column and to pass the remainder via a separate gas conduit into the low-pressure column. It is additionally possible to introduce gas from the low-pressure column into the auxiliary column. In the simplest case, the auxiliary column of the invention comprises precisely two mass transfer sections, wherein at least a portion of the crude oxygen from the high-pressure column is supplied to the intermediate point between the two mass transfer sections; alternatively, the auxiliary column comprises three or more mass transfer sections. The mass transfer sections consist of structured packing, conventional rectifying trays such as for instance sieve trays or of a combination of different types of mass transfer elements.

The auxiliary column obtains reflux from the high-pressure column or the main condenser.

The cooling liquid for the argon discharge column tops condenser may come exclusively from the bottom of the high-pressure column when all reflux liquid from the auxiliary column is withdrawn above the column bottom. If only a portion of the reflux liquid or even none of the reflux liquid is withdrawn from the auxiliary column then said liquid mixes with the cooling liquid from the bottom of the high-pressure column. Said liquid may be introduced directly into the evaporation space of the argon discharge column tops condenser. Alternatively, said liquid is introduced into the auxiliary column above the column bottom; it then flows through a mass transfer section into the bottom of the auxiliary column and thus into the evaporation space of the argon discharge column tops condenser.

It is preferable when a gaseous tops fraction is obtained from the auxiliary column as a gaseous nitrogen product separate from the gaseous tops nitrogen from the low-pressure column. Owing to this direct product withdrawal from the auxiliary column, the corresponding gas amount is not even introduced into the low-pressure column, thus disburdening said column. A "gaseous nitrogen product" is herein to be understood as meaning a gas having a higher nitrogen content than air. This may be a residual gas further comprising 0.1 to 7 mol % of oxygen. In a further embodiment it is also possible to obtain nitrogen of technical purity having an oxygen content as low as 1 ppm.

The gas from the evaporation space of the argon discharge column tops condenser could in principle be passed via conduits to the bottom region of the auxiliary column. The argon discharge column tops condenser and the auxiliary column could then be arranged in two separate containers. However, it is generally more advantageous when the auxiliary column and the argon discharge column tops condenser are enclosed by a common container and in particular the argon discharge column tops condenser is arranged in the bottom of the auxiliary column. The argon discharge column tops condenser is thus simultaneously the bottoms evaporator of the auxiliary column.

The plant according to the invention may additionally comprise one or more liquid conduits for one or more liquids from one or more intermediate points or the bottom of the axillary column. Each of these liquids is introduced into the low-pressure column. Reflux liquid and/or bottoms liquid from the auxiliary column is thus introduced into the low-pressure column as additional intermediate reflux.

It is also advantageous when the plant has a further intermediate feed for introduction of an additional liquid or gaseous fraction into the auxiliary column at a second intermediate point. Here, an additional liquid fraction, in particular a liquid air fraction, is introduced into the auxiliary column at a second intermediate point arranged above the first intermediate point. One or more such further intermediate feeds may be provided, through each of which a respective gas or liquid fraction, for example liquid air, is introduced into the auxiliary column and likewise participates in the nitrogen-oxygen separation in the auxiliary column rather than in the low-pressure column. This may be any fraction whose nitrogen content is between that at the bottom of the auxiliary column/in the evaporation space of the argon discharge column tops condenser and that at the top of the auxiliary column, for example even gaseous air from a turbine decompression. Each such intermediate feed contributes further to the optimization of the load distribution between the low-pressure column and the auxiliary column and to optimal liquid-to-vapor ratios in the respective mass transfer sections of the low-pressure column and the auxiliary column. In particular, the efficiency of the rectification in the auxiliary column is optimized.

In the context of the invention, the high-pressure column and the low-pressure column may be arranged side-by-side and the argon discharge column tops condenser and the auxiliary column may be arranged over the high-pressure column.

The side-by-side arrangement of the high-pressure column and the low-pressure column is known per se, for example from DE 827364 or U.S. Pat. No. 2,762,208. This reduces the in-transport length of the columns compared to a double column arrangement and transport to construction sites is less costly and complex.

An arrangement of two columns "side-by-side" is to be understood as meaning that the two columns in normal operation of the plant are positioned such that the projections of their cross sections in a horizontal plane do not overlap. The lower ends of the two columns are then often at identical geodetic height plus/minus 5 m.

An arrangement of two columns "one above the other" or "one below the other" is to be understood as meaning that the two columns in normal operation of the plant are positioned such that the projections of their cross sections in a horizontal plane overlap. For example when the two columns are arranged exactly one above the other, the axes of the two columns proceed on the same vertical straight line.

Owing to the arrangement of the argon discharge column tops condenser and the auxiliary column over the high-pressure column, these apparatuses require no additional building area; the footprint of the plant remains identical. Even for plants with a height limit this one-above-the-other arrangement is unproblematic because the high-pressure column is markedly lower than the low-pressure column. This setup is also advantageous from a process engineering perspective because no process pump is required for liquid transport other than the oxygen or nitrogen pump on the main condenser which is obligatory for side-by-side arrangement of the main columns. In a first variant of the invention, the argon discharge column may be arranged below the argon discharge column tops condenser. It is preferable when the auxiliary column and the argon discharge column form a double column with the argon discharge column tops condenser as the "main condenser". This double column then preferably stands directly on the top of the high-pressure column. In the case of one-above-the-other arrangement of the high-pressure column and the low-pressure column, the combination of the auxiliary column, argon discharge column tops condenser and argon discharge column stands or hangs next to the double column composed of the high-pressure column and the low-pressure column.

In a second variant of the invention the argon discharge column and the argon discharge column tops condenser are arranged spatially separate from one another; in particular the argon discharge column is arranged in a dividing wall column region of the low-pressure column. The combination of the argon discharge column tops condenser and the auxiliary column remains situated outside the low-pressure column, in particular over the high-pressure column.

The high-pressure column and the low-pressure column preferably have an identical column diameter. "Identical" is herein to be understood as meaning a deviation of less than 0.4 m. This allows a predetermined maximum diameter to be optimally utilized. The high-pressure column (1), low-pressure column (2) and auxiliary column (14) may for example have a diameter of more than 3.5 m, in particular of more than 4.1 m. The high-pressure column, low-pressure column and auxiliary column of the invention preferably have a diameter of more than 3.5 m, in particular of more than 4.1 m. It is advantageous when the mass transfer elements in the auxiliary column are formed by structured packing having an identical or greater specific surface area than that in the low-pressure column. When for example the low-pressure column packings of 500 and 750 $m^2/m^3$ are employed, the packing density in the auxiliary column is for example 750 or up to 1200 $m^2/m^3$.

In addition it is advantageous not to introduce the entirety of the liquid effluxing from the mass transfer region of the auxiliary column into the evaporation space of the argon discharge column tops condenser but rather to provide a cup or another means for catching at least a portion of the liquid downflowing in the auxiliary column immediately above the column bottom connected to means for introducing the collected liquid into the low-pressure column.

Alternatively to arranging the argon discharge column tops condenser in the bottom of the auxiliary column, the auxiliary column and the argon discharge column tops condenser may be arranged in separate containers. This allows greater flexibility in the arrangement of the plant parts.

In particular, two combinations of plant parts may then be arranged side-by-side, namely the argon discharge column over the high-pressure column, in particular over the main condenser, and the auxiliary column over the low-pressure column. It is similarly advantageous when the high-pressure column and the low-pressure column are arranged side by side, the argon discharge column is arranged above the low-pressure column and the auxiliary column is arranged next to the combination of the low-pressure column and the argon discharge column and above the high-pressure column, in particular above the main condenser. This results in a particularly space-saving arrangement which is advantageous from a transportation perspective.

BRIEF DESCRIPTION OF THE DRAWINGS

The invention—and further details of the invention—are more particularly elucidated hereinbelow with reference to two exemplary embodiments depicted in schematic form in the drawings. The drawings depict only the most important elements, in particular those which distinguish the system of the invention from customary air separation systems.

Figure 1:
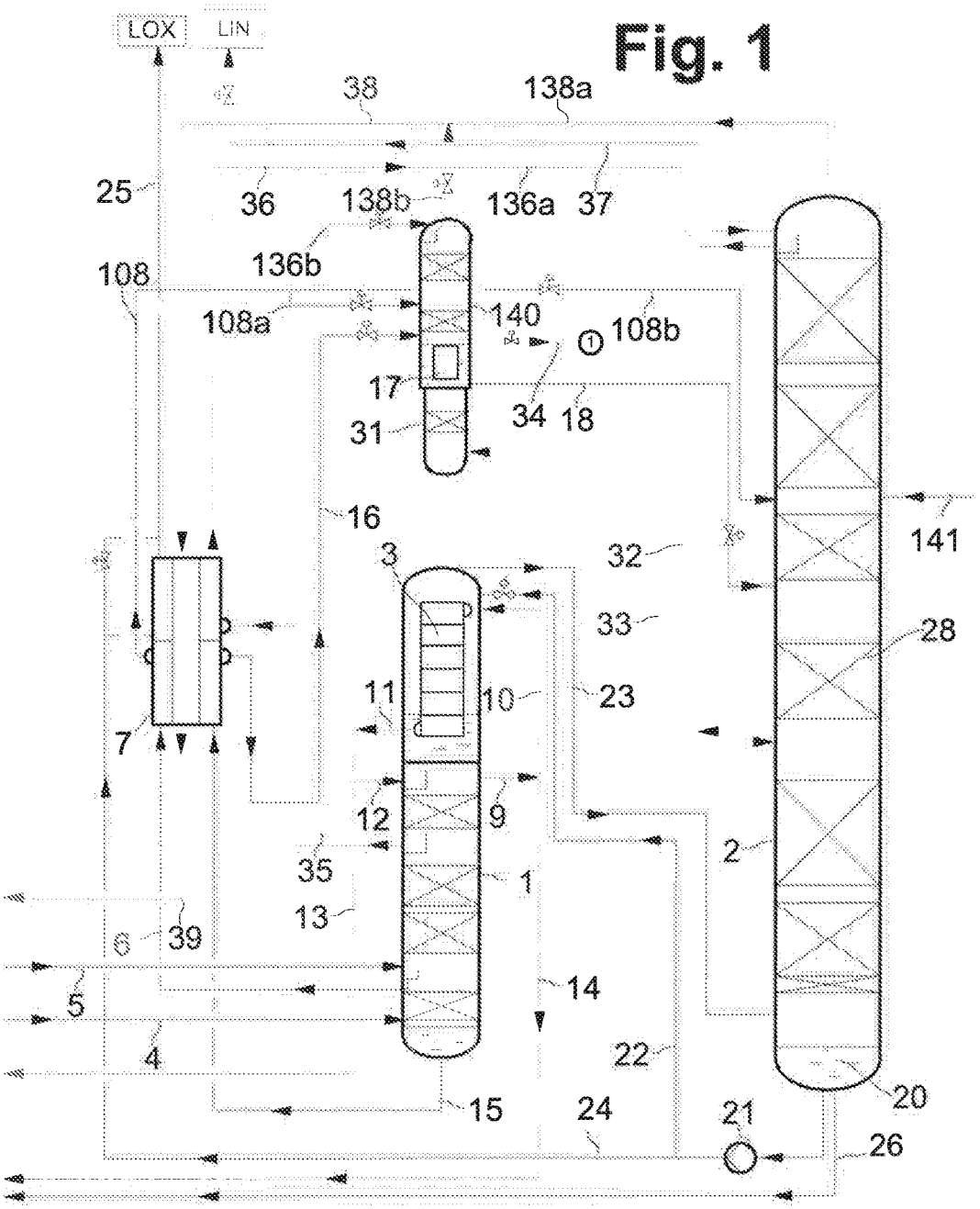
FIG. 1 shows a first exemplary embodiment for a plant according to the first variant of the invention having a double column composed of an auxiliary column and an argon discharge column above the high-pressure column.

Air compression means, air purification means and main heat exchangers are not shown in the drawings. The representation is also simplified in other respects; some streams which are not relevant to the understanding of the invention are not marked.

DETAILED DESCRIPTION OF THE INVENTION

The plant of the exemplary embodiment in FIG. 1 comprises a high-pressure column 1, a low-pressure column 2 and a main condenser 3. The main condenser 3 is here configured as a multi-level bath evaporator, more particularly as a cascade evaporator. The high-pressure column 1 and the low-pressure column 2 are arranged side by side; in particular their lower ends are situated at the same geodetic level.

A first substream 4 of the feed air flows in gaseous form into the high-pressure column 1 immediately above the column bottom. A second portion 5 of the feed air is at least partly liquid and is supplied to the high-pressure column 1 at an intermediate point. At least a portion of the liquid air is immediately withdrawn again via conduit 6, cooled in a countercurrent subcooler 7 and via the conduits 108 and 108*b* at least partly supplied to the low-pressure column 2 at a first intermediate point.

In the main condenser 3 a portion 10 of the gaseous tops nitrogen 9 from the high-pressure column 1 is at least partly condensed. A first portion 12 of the thus obtained liquid nitrogen 11 is applied to the top of the high-pressure column 1 as reflux. A second portion 13 is supplied to an internal compression means (not shown) and finally obtained as gaseous compressed nitrogen product. Another portion 14 of the gaseous tops nitrogen 9 is heated in the main heat exchanger (not shown) and obtained directly as gaseous compressed product.

Liquid crude oxygen 15 from the high-pressure column 1 is cooled in the countercurrent subcooler 7 and is supplied via the conduits 16 and 18 and also through an argon discharge column tops condenser 17 to the low-pressure column 2 at a second intermediate point which is situated below the first intermediate point.

Liquid impure nitrogen 35 is withdrawn from an intermediate point on the high-pressure column 1, cooled in the countercurrent subcooler and via conduit 36/136*a* applied to the top of the low-pressure column 2. A portion thereof may be obtained via conduit 37 as liquid nitrogen product (LIN). Gaseous impure nitrogen 138*a* is withdrawn from the top of low-pressure column 2 and after heating in the countercurrent subcooler 7 sent on via conduit 39 to the main heat exchanger (not shown).

A first portion 22 of the liquid oxygen 20 from the bottom of the low-pressure column 2 is conveyed using a pump 21 into the evaporation space of the main condenser 3 and at least partially evaporated therein. Gas thus formed 23 is recycled into the bottom of the low-pressure column 2 and serves therein as ascending gas. A second portion 24 of the liquid oxygen 20 is cooled in the countercurrent subcooler 7 and withdrawn via conduit 25 as liquid oxygen product (LOX). A third portion 26 of the liquid oxygen 20 is supplied to an internal compression means (not shown) and finally obtained as gaseous compressed oxygen product which is the primary product of the plant.

An argon discharge column 31 is as usual connected via a gas feed 32 and a liquid return conduit 33 to an intermediate point on the low-pressure column 2. Liquid reflux for the argon discharge column is produced in the liquefaction space of the argon discharge column tops condenser 17. The gaseous residual product 34 is withdrawn from the liquefaction space and heated in the main heat exchanger.

An auxiliary column 140 is situated in the same container as the argon discharge column tops condenser 17 which functions as a bottoms heating means for the auxiliary column and produces ascending vapor therefor. A portion 136*b* of the subcooled liquid impure nitrogen 36 from the high-pressure column 1 is employed as reflux liquid at the top of the auxiliary column 140.

A portion 108*a* of the subcooled liquid air 108 may be supplied to the auxiliary column 140 at a "second intermediate point". Another portion 108*b*, along with a stream 141 of turbine-decompressed air 141, is supplied to the low pressure column 2 at the same intermediate point or higher (not shown).

Gaseous impure nitrogen 138*b* is withdrawn from the top of the auxiliary column 140 and mixed with the gaseous impure nitrogen 138*a* from the top of the low-pressure column 2. The overall stream 38 after heating in the countercurrent subcooler 7 is sent on via conduit 39 to the main heat exchanger (not shown). Alternatively, the two nitrogen streams 138*a*, 138*b* may also be passed to, and through, the main heat exchanger separately.

With the aid of auxiliary column 140 the top section of the low-pressure column is disburdened. Said section can therefore be configured with a lower capacity; conversely for the same dimensions of the low-pressure column the capacity of the plant is a whole can be increased.

In this exemplary embodiment the pressure difference at the column top between the auxiliary column and the low-pressure column is 50 to 150 mbar. Departing from the pictorial representation in FIG. 1, the tops fractions 138*a*,

138*b* from the low-pressure column 2 and the auxiliary column 140 may be withdrawn at slightly different pressures, passed through the countercurrent subcooler 7 and supplied to the main heat exchanger (not shown). This also applies to the following exemplary embodiments.

The exemplary embodiment in FIG. 2 differs from that of FIG. 1 in that the argon discharge column 17 is not arranged below the argon discharge column tops condenser 17 but rather in a dividing wall section A2 of the low-pressure column 2. Equivalent elements bear the same reference numerals in both drawings.

Figure 2:
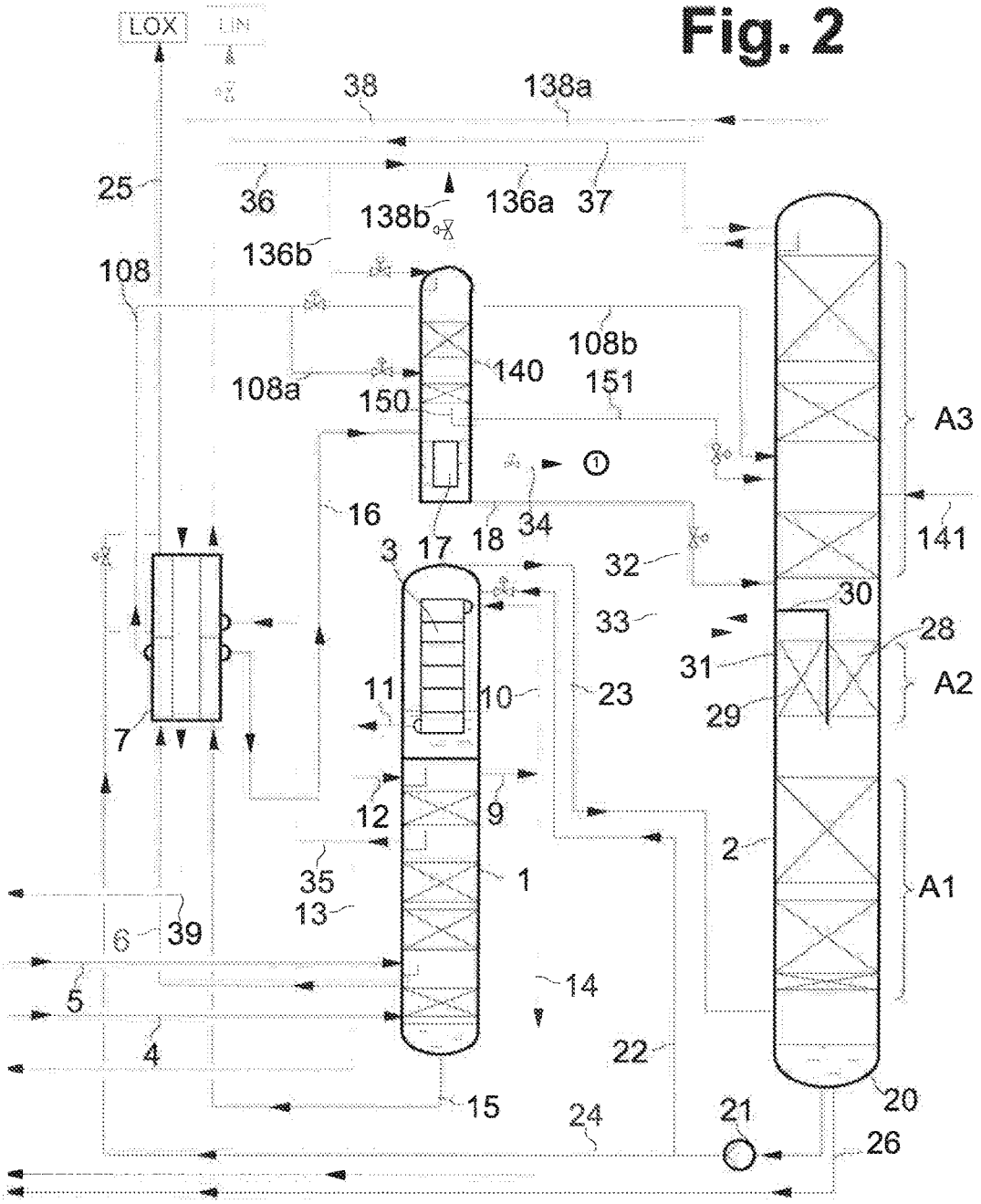
FIG. 2 shows a second exemplary embodiment according to the second variant of the invention where the argon discharge column is arranged in a dividing wall column region of the low-pressure column.

FIG. 2 describes three sections of the low-pressure column 2: a lower section A1, a middle section A2 and a top section A3.

The middle section A2 of the low-pressure column 2 is configured as a dividing wall section. A vertical dividing wall 27 separates a first subspace 28 and a second subspace 29 from one another. The dividing wall is formed in the example by a flat piece of sheet metal which is welded to the column wall on both sides. Both subspaces contain mass transfer elements, for example structured packing. The mass transfer layers in the subspaces may, but need not, be of identical height. The two subspaces may be of identical or different sizes.

The first subspace 28 forms the argon section of the low-pressure column 1. It is in fluid communication with the lower section at the bottom and with the upper section at the top. Thus a first portion of the gas can flow from the lower section through the first subspace 28 to the upper section A3. Conversely, liquid flows from the upper section A3 through the first subspace 28 into the lower section A1.

The second subspace 29 forms the argon discharge column 31. Said subspace is likewise in fluid communication with the lower section A1 and a second portion of the gas ascending from the first section A1 can therefore flow in from there. However, said subspace is gas tightly sealed with respect to the upper section A3 with a horizontal wall 30. The horizontal wall has an approximately semicircular configuration and is welded to the column wall and the dividing wall 27. Neither can gas flow from the top of the argon discharge column 31 into the top section A3 nor can liquid from there penetrate into the argon discharge column 31.

At the top of the argon discharge column 31 argon-enriched gas 32 is withdrawn and partly liquefied in the liquefaction space of the argon discharge column tops condenser 17. The thus produced liquid 33 is recycled as reflux into the argon discharge column 31. The proportion remaining in gaseous form is withdrawn from the argon discharge column tops condenser 17 in gaseous form as argon-enriched product or residual gas 34 and passed through the main heat exchanger (not shown) through a separate passage group.

Due to the integration of the argon discharge column 31 into the low-pressure column 2 and due to the arrangement of the argon discharge column tops condenser over the high-pressure column 1, the argon discharge requires no additional setup area compared to the pure nitrogen-oxygen separation. The increase in the oxygen yield can accordingly be achieved without any appreciable enlargement of the plant.

In addition, the exemplary embodiment in FIG. 2 comprises a cup 150 in the auxiliary column 140 and a conduit 151. The liquid downflowing in the auxiliary column 140 is collected in the cup 150 above the argon discharge column tops condenser completely, partly or not at all. The collected liquid is partly or completely introduced into the low-pressure column 2 via the conduit 151, preferably above the conduit 18. This avoids mixing of this liquid with the liquid crude oxygen 16 from the high-pressure column 1/the unevaporated liquid from the evaporation space of the argon discharge column tops condenser 17. Advantageous control of the argon discharge column tops condenser is also possible.

The cup 150 and the conduit 151 may also be employed in all other exemplary embodiments. Instead of the cup, any other collecting device for liquid may be used. For example, the liquid may be collected in a chimney tray or withdrawn from a rectifying tray or its downcomer.

Figure 3:
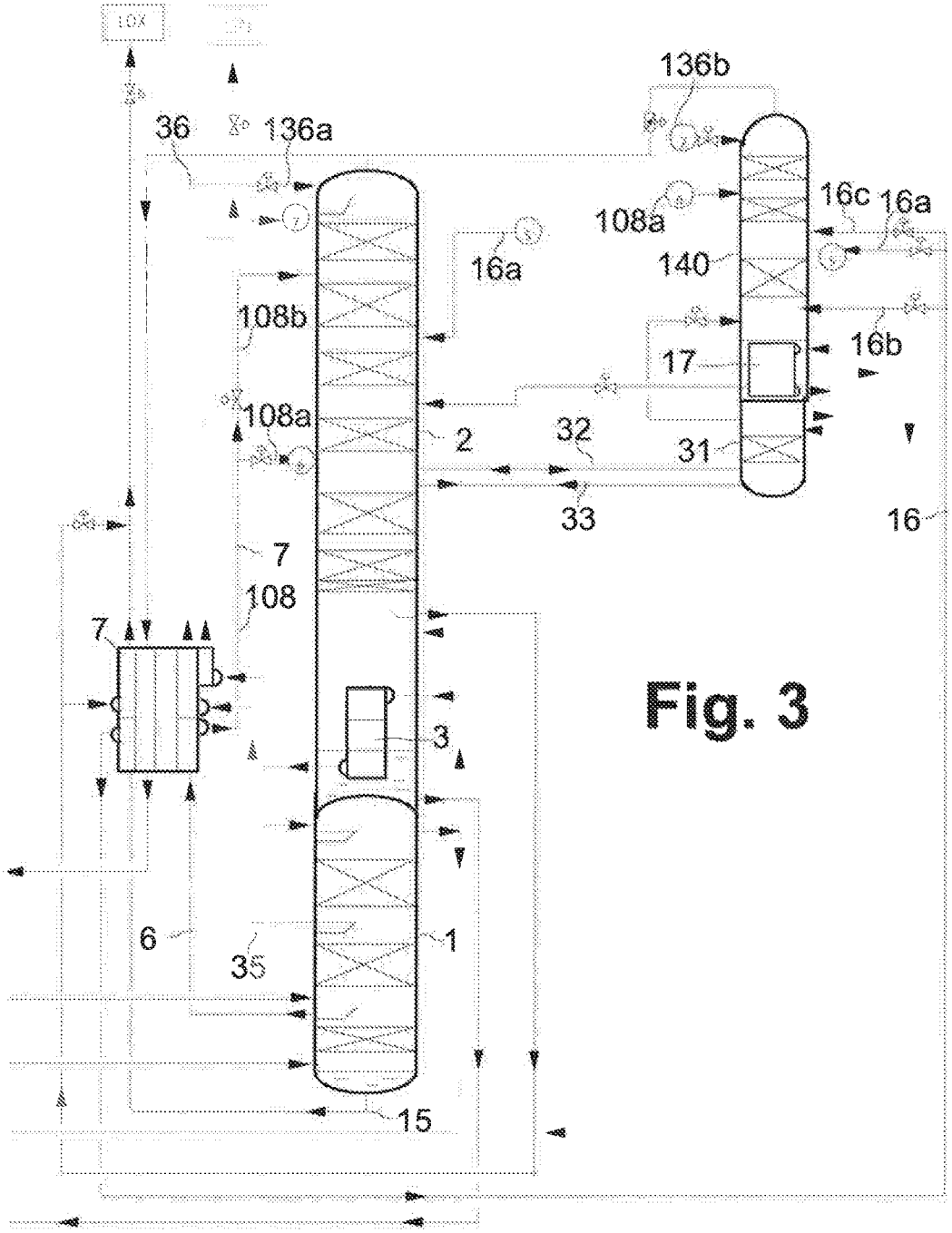
FIG. 3 shows a third exemplary embodiment similar to FIG. 1 but with one-above-the-other arrangement of the high-pressure column and the low-pressure column.

In FIG. 3 the high-pressure column 1, main condenser 3 and low-pressure column 2 are arranged one above the other in the form of a conventional double column. The auxiliary column 140, argon discharge column tops condenser 17 and argon discharge column 31 likewise form a double column similarly to FIG. 1. However, said column is not arranged above the high-pressure column 1 but rather next to the double column composed of the high-pressure column 1 and the low-pressure column 2, for example on a scaffold.

In addition, not the entirety of the crude oxygen 16 is passed from the bottom of the high-pressure column 1 into the evaporation space of the argon discharge column tops condenser, but rather, via conduit 16*b*, only a portion. Another portion passes directly via conduit 16*a* directly into the low-pressure column 2, the remainder via conduit 16*c* to a "first intermediate point" on auxiliary column 140.

Figure 4:
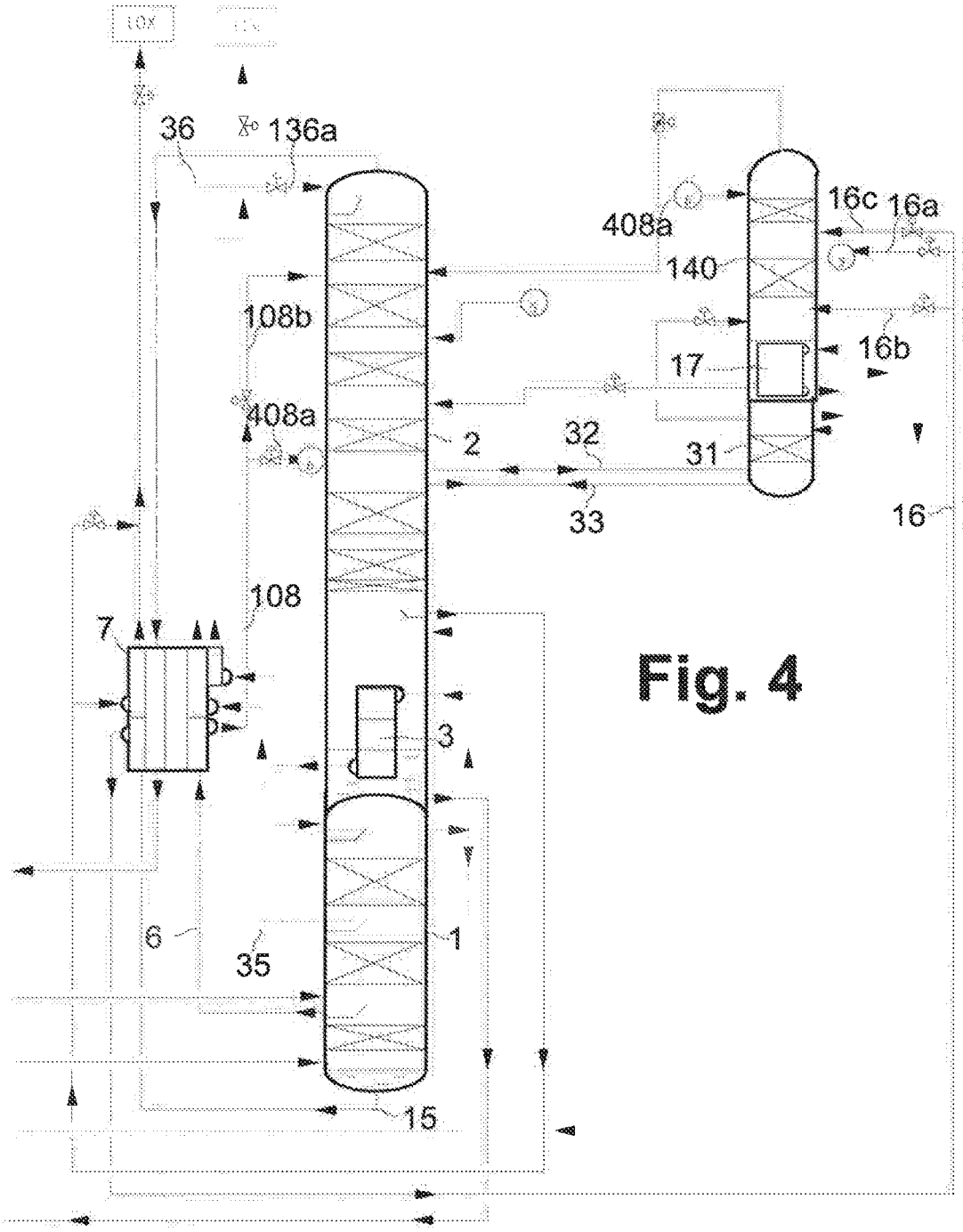
FIG. 4 shows a modification of FIG. 3 having a shorter auxiliary column.

In FIG. 4 the auxiliary column 140 is slightly shorter than in FIG. 3, the tops reflux is here formed by liquid air 108. This is applied via the "reflux liquid conduit" 408*b* to the top of the auxiliary column 140.

Figure 5:
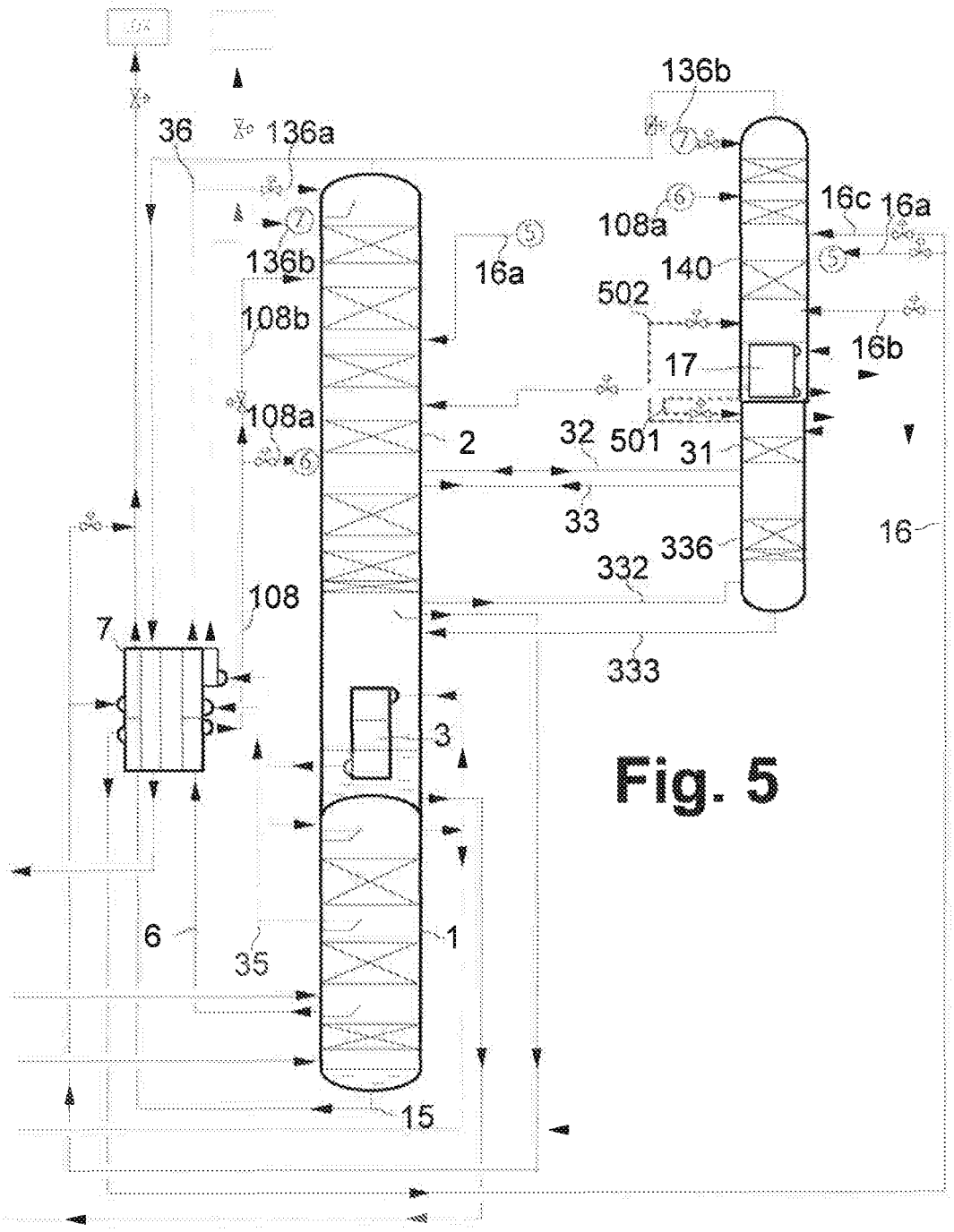
FIG. 5 shows the exemplary embodiment of FIG. 3 supplemented with an oxygen column.

In FIG. 5 the argon discharge column is effectively extended downward compared to FIG. 3. Situated in the same container as the argon discharge column 31 is an oxygen column 336 in the form of an additional distillation section. The lower end of the oxygen column 336 communicates via the gas conduit 332 and the liquid conduit 333 with the low-pressure column 2 immediately above the bottom thereof.

The top of the oxygen column 336 receives reflux liquid from the conduit 33 and/or via at least a portion of the liquid effluxing from the argon discharge column 31. The capacity of the oxygen column 36 may be adjusted with the two conduits 32, 33. If the liquid conduit 33 is closed (or is omitted), the capacity is precisely distributed between the two columns such that the conversion of the oxygen column 336 is equal to the conversion of the argon discharge column 31. If more capacity is to be shifted into the oxygen column 336, liquid is transported—counter to the flow direction marked in FIG. 1—from the low-pressure column 2 into the oxygen column 36 via the liquid conduit 33. This additional capacity is withdrawn from the oxygen column 336 below the argon discharge column 31 and supplied to the low-pressure column 2 as the corresponding gas amount.

FIG. 5 also depicts with dashed lines two bypass conduits 501, 502 which make it possible to shut down the argon discharge column tops condenser 17 and continue to operate the rest of the plant. Conduit 501 then passes the liquid from the bath of the argon discharge column tops condenser 17 to the top of the argon discharge column 31. In countercurrent, via conduit 502, the tops steam from the argon discharge column 31 is passed into the auxiliary column 140. This feature may be combined with all other exemplary embodiments.

Figure 6:
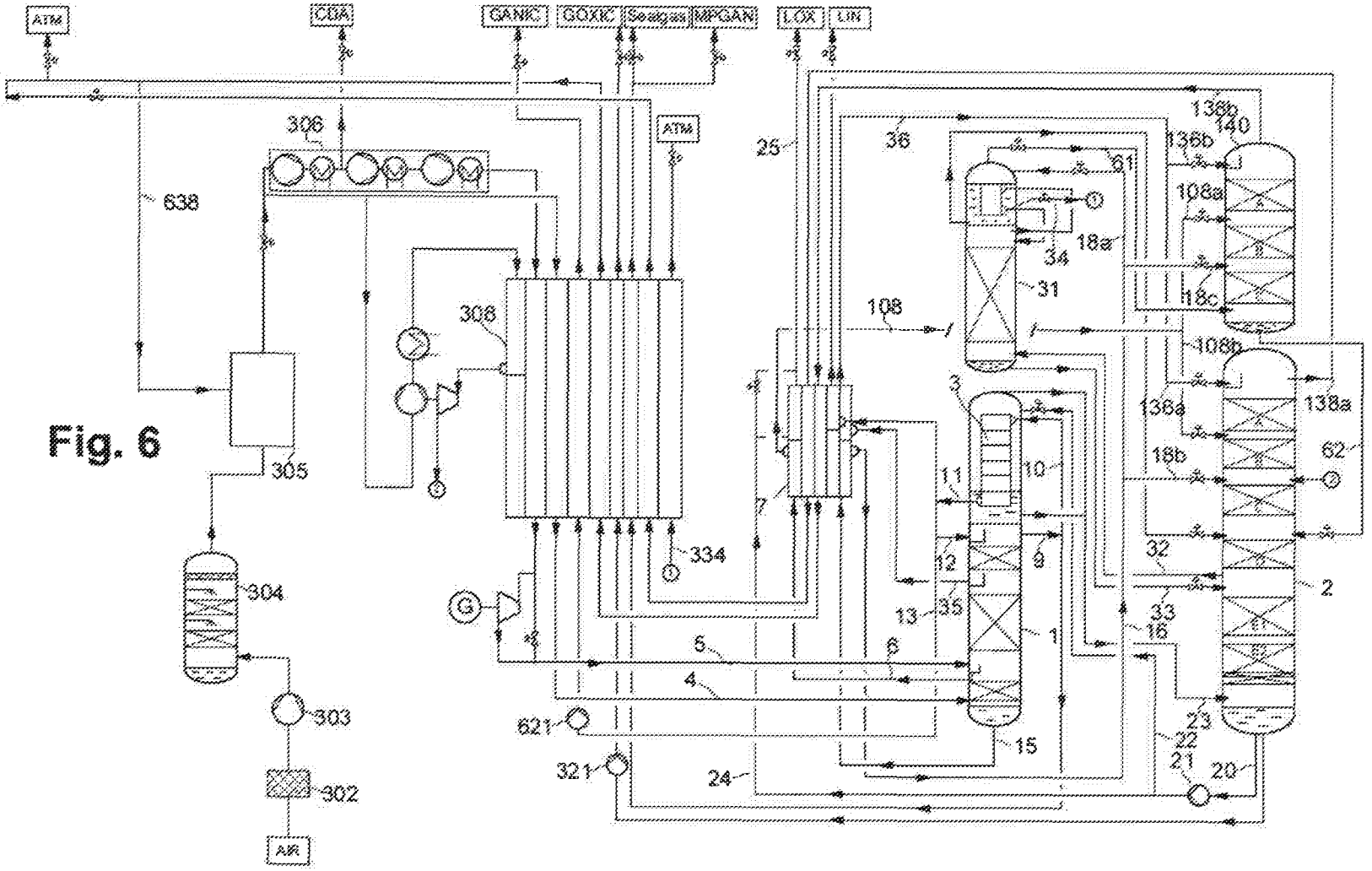
FIG. 6 shows a further exemplary embodiment having the auxiliary column over the low-pressure column.

The plant depicted in FIG. 6 comprises an entry filter 302 for atmospheric air (AIR), a main air compressor 303, an air pre-cooling unit 304, and air purification unit 305 (typically formed by a pair of molecular sieve adsorbers), a three-stage, intermediately cooled and post-cooled booster air compressor 306 (BAC) and a main heat exchanger 308. A first substream 4 of the feed air flows in gaseous form into the high-pressure column 1 immediately above the column bottom. A second portion 5 of the feed air is at least partly liquid and is supplied to the high-pressure column 1 at an intermediate point. At least a portion of the liquid air is immediately withdrawn again via conduit 6, cooled in a countercurrent subcooler 7 and via the conduits 108 and 108*b* at least partly supplied to the low-pressure column 2 at a first intermediate point.

In the main condenser 3 a portion 10 of the gaseous tops nitrogen 9 from the high-pressure column 1 is at least partly condensed. A first portion 12 of the thus obtained liquid nitrogen 11 is applied to the top of the high-pressure column 1 as reflux. A second portion 13 is supplied to an internal compression means (pump 313) and finally obtained as gaseous compressed nitrogen product. Another portion 14 of the gaseous tops nitrogen 9 is internally compressed (pump 621), heated in the main heat exchanger 308 and obtained directly as gaseous compressed product (GANIC).

Liquid crude oxygen 15 from the high-pressure column 1 is cooled in the countercurrent subcooler 7, sent on via conduit 16 and then via the conduits 18*a*, 18*b*, 18*c* divided among the argon discharge column tops condenser 17, the low-pressure column 2 and the auxiliary column 140, supplied at a second intermediate point which is situated below the first intermediate point.

Liquid impure nitrogen 35 is withdrawn from an intermediate point on the high-pressure column 1, cooled in the countercurrent subcooler and via the conduits 36 and 136*a*/136*b* applied to the top of the low-pressure column 2 to the top of auxiliary column 140. A first stream of gaseous impure nitrogen 138*a* is withdrawn from the top of the low-pressure column 2 and after heating in the countercurrent subcooler 7 via conduit 39. After heating main heat exchanger (308), this stream is blown off to the atmosphere (ATM).

A first portion 22 of the liquid oxygen 20 from the bottom of the low-pressure column 2 is conveyed using a pump 21 into the evaporation space of the main condenser 3 and at least partially evaporated therein. Gas thus formed 23 is recycled into the bottom of the low-pressure column 2 and serves therein as ascending gas. A second portion 24 of the liquid oxygen 20 is cooled in the countercurrent subcooler 7 and withdrawn via conduit 25 as liquid oxygen product (LOX). A third portion 26 of the liquid oxygen 20 is internally compressed, i.e. brought to the desired product pressure by means of a pump 321, heated in the main heat exchanger 308 and finally obtained as gaseous pressurized oxygen product (EOXIC) which is the primary product of the plant.

The argon discharge column 31 is as usual connected via a gas feed 32 and a liquid return conduit 33 to an intermediate point on the low-pressure column 2. Liquid reflux for the argon discharge column is produced in the liquefaction space of the argon discharge column tops condenser 17. The gaseous residual product 34, 334 is withdrawn from the liquefaction space, heated in the main heat exchanger 308 and finally released to the atmosphere (ATM); it could alternatively be obtained as an argon-enriched product.

The auxiliary column 140 and the argon discharge column tops condenser 17 are situated in separate containers. However, the gas conduit 61 ensures—as in the preceding exemplary embodiments—that gas produced in the evaporation space of the argon discharge column tops condenser 17 continues to be introduced into the bottom of the auxiliary column 140 and is available there as ascending vapor. Liquid generated in the bottom of the auxiliary column 140 is supplied to the low-pressure column 2 at a suitable intermediate point via a liquid conduit 62. A portion 136*b* of the subcooled liquid impure nitrogen 36 from the high-pressure column 1 is employed as reflux liquid at the top of the auxiliary column 140.

A portion 108*a* of the subcooled liquid air 108 may be supplied to the auxiliary column 140 at an intermediate point. From the top of the auxiliary column 140 a second stream of gaseous impure nitrogen 138*b* is withdrawn at a slightly higher pressure than the stream 138*a*, heated separately from the first stream 138*a* in countercurrent subcooler 7 and main heat exchanger 308 and via conduit 638 at least partly/at least intermittently employed as regeneration gas in the air purification unit 305.

In all exemplary embodiments the gas conduit 32 and the liquid conduit 33 between the low-pressure column and the argon discharge column may also be combined in a single conduit having a particularly large cross section. Furthermore, the low pressure column may be supplemented by an additional nitrogen section which receives a dedicated reflux, preferably liquid nitrogen from the high-pressure column or from the main condenser. Alternatively, the auxiliary column may also produce purer nitrogen than the low-pressure column when the auxiliary column receives reflux from a purer part of the high-pressure column. Furthermore, individual elements, a plurality of elements or all elements such as the air compression, the air pre-cooling, the air purification, the interconnection of the main heat exchanger and the turbines and the management of the impure nitrogen products from FIG. 6 may each be combined with other exemplary embodiments.

Figure 7:
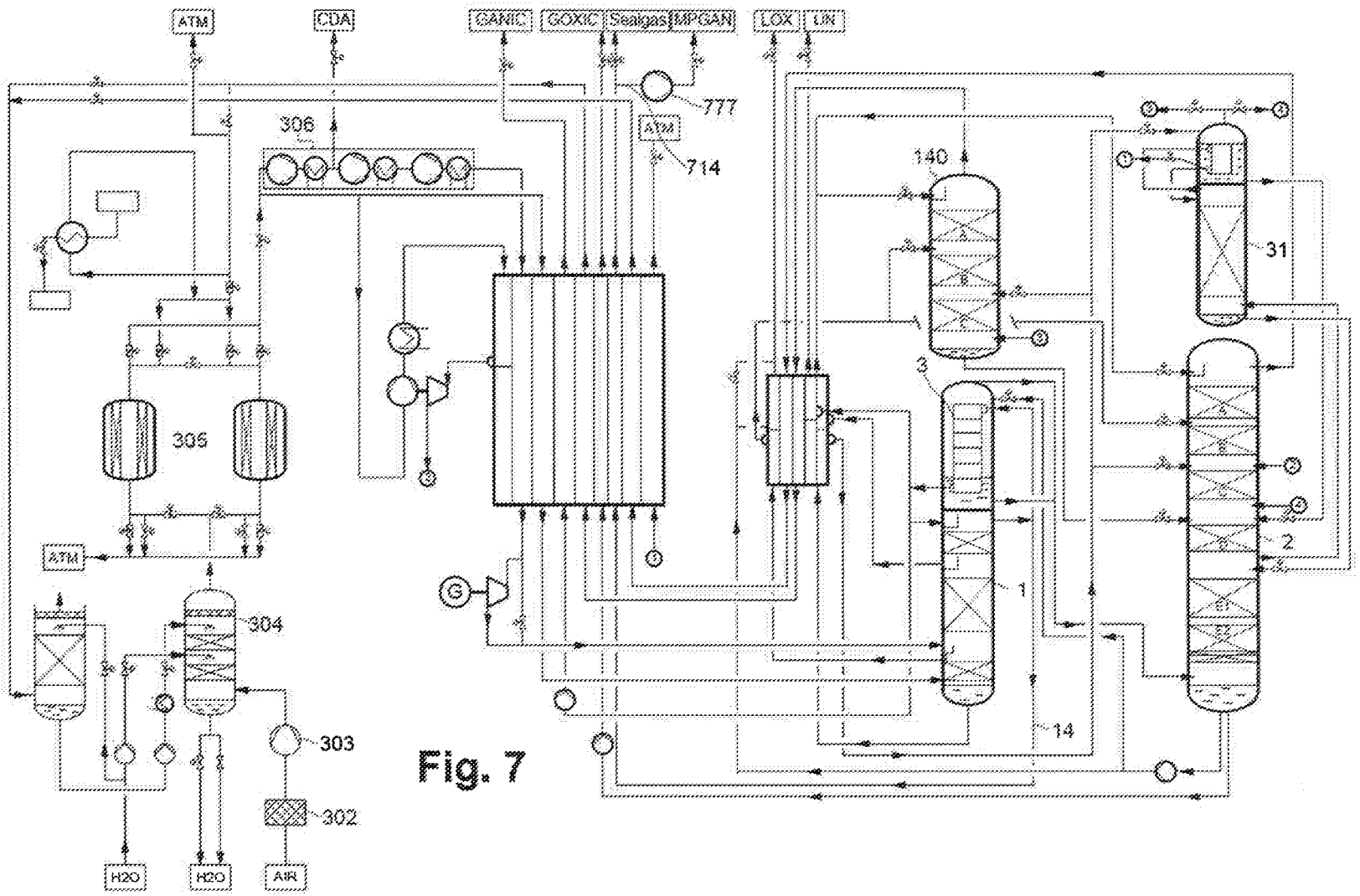
FIG. 7 shows a variant having the auxiliary column over the high-pressure column and the main condenser and FIG. 8 shows a system similar to FIG. 2 but with the argon condenser arranged in the low-pressure column.

In terms of process engineering, FIG. 7 corresponds largely to FIG. 6, though the argon discharge column 31 and the auxiliary column 140 are interchanged here. The auxiliary column stands above the high-pressure column 1 and the main condenser 3, the argon discharge column 31 is arranged above the low-pressure column 2. In addition, a nitrogen compressor 777 is also provided here in order to further increase product pressure of the gaseous nitrogen 14, 714 with respect to the high-pressure column pressure.

Figure 8:
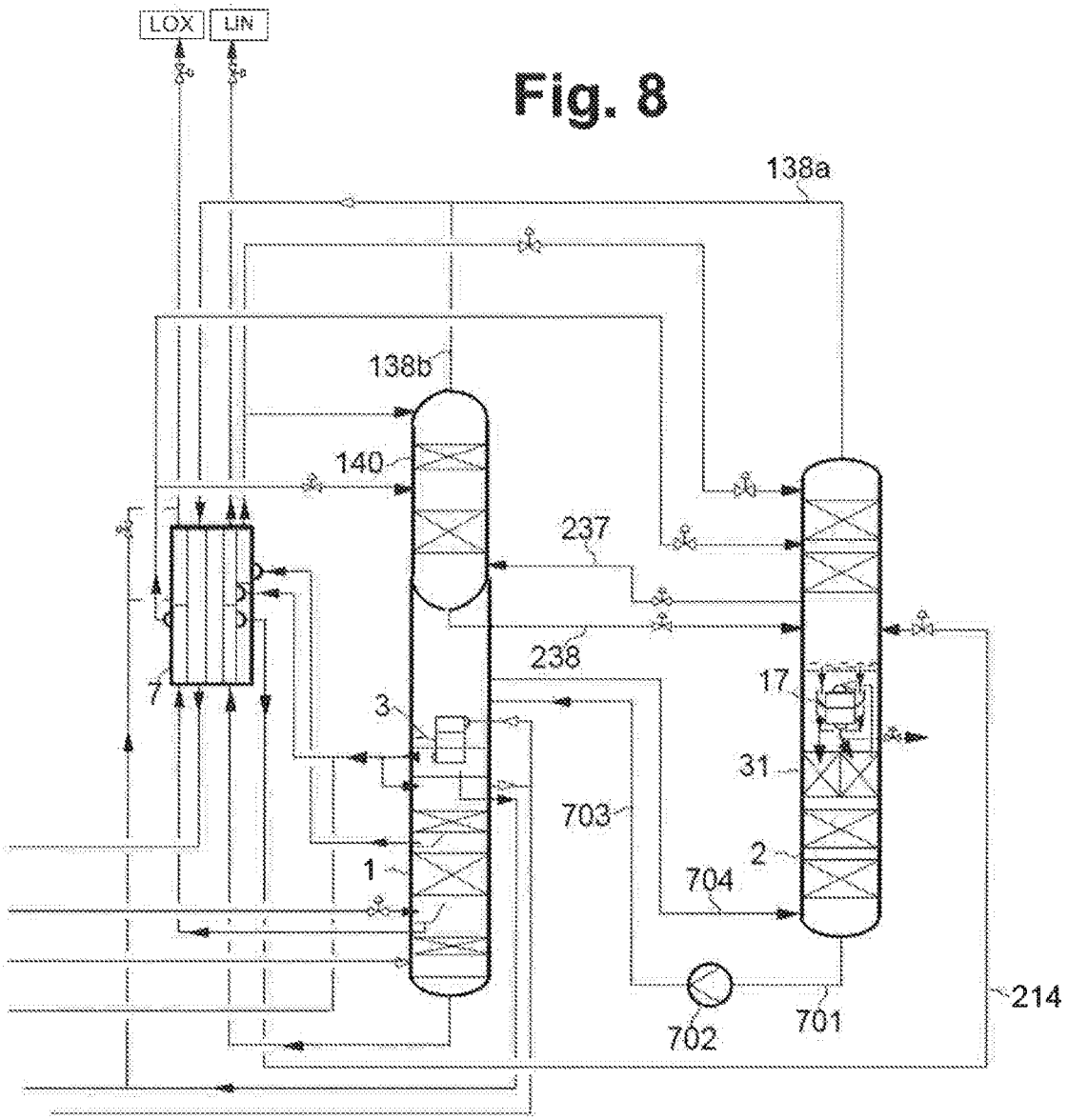

FIG. 8 depicts a system similar to that of FIG. 3. In particular, the low-pressure column 2 contains a dividing wall section 253. In contrast to FIG. 2 the argon condenser 17 is incorporated in the low-pressure column and is not configured as a simple bath evaporator but rather as a bilevel pocket evaporator (also known as a cascade evaporator). The bottom of the auxiliary column 140 is in fluid communication with the evaporation space of the argon condenser 17 via a gas conduit 237 and a liquid conduit 238. Departing from the pictorial representation in FIG. 8, the tops fractions 138*a*, 138*b* from the low-pressure column 2 and the auxiliary column 140 are withdrawn at slightly different pressures, passed through the countercurrent subcooler 7 separately and supplied to the main heat exchanger (not shown) separately.

What we claim is:

1. A method for producing oxygen by low-temperature separation of air in a distillation column system which comprises a high-pressure column and a low-pressure column, a main condenser which is a condenser evaporator having a liquefaction space and an evaporation space, wherein the liquefaction space of the main condenser is in fluid communication with the top of the high-pressure column and the evaporation space of the main condenser is in fluid communication with the low-pressure column, an argon discharge column which is in fluid communication with an intermediate point on the low-pressure column, an argon discharge column tops condenser which is a condenser-evaporator having a liquefaction space and an evaporation space, wherein the liquefaction space of the argon discharge column tops condenser is in fluid communication with the top of the argon discharge column, an auxiliary column whose bottom region is configured for introduction of gas from the evaporation space of the argon discharge column tops condenser, said method comprising:

introducing liquid crude oxygen from the bottom of the high-pressure column into the auxiliary column, introducing a liquid stream from the high-pressure column or the main condenser as reflux into the top of the auxiliary column via a reflux liquid conduit, wherein the liquid stream has a nitrogen content at least equal to that of air, and supplying at least a first portion of the liquid crude oxygen to the auxiliary column at a first intermediate point, wherein the operating pressure at the top the auxiliary column is at least 50 mbar higher than the operating pressure at the top of the low-pressure column.

2. The method as claimed in claim 1, wherein a gaseous fraction is withdrawn from the top of the auxiliary column as a gaseous nitrogen product separately from a gaseous nitrogen product stream withdrawn from the top of the low-pressure column.

3. The method as claimed in claim 1, wherein an additional liquid fraction is introduced into the auxiliary column at a second intermediate point which is arranged above the first intermediate point.

4. The method as claimed in claim 3, wherein the additional liquid fraction is a liquid air fraction.

5. The method as claimed in claim 1, wherein at least a portion of liquid downflowing in the auxiliary column is collected immediately above the column bottom as collected fluid, and at least a portion of the collected liquid is introduced into the low-pressure column.

6. The method as claimed in claim 1, wherein no gas stream is passed from the low-pressure column into the auxiliary column.

7. The method as claimed in claim 1, wherein a second portion of the liquid crude oxygen is supplied to the auxiliary column at the bottom or to the evaporation space of the argon condenser and a third portion of the liquid crude oxygen is supplied to the low-pressure column at an intermediate point.

8. The method as claimed in claim 1, wherein the high-pressure column and the low-pressure column are arranged side by side and the argon discharge tops condenser and the auxiliary column are arranged over the high-pressure column.

9. The method as claimed in claim 1, wherein the argon discharge column and the argon discharge column tops condenser are arranged spatially separate from one another.

10. The method as claimed in claim 1, wherein the argon discharge column is arranged in a dividing wall column region of the low-pressure column.

11. The method as claimed in claim 1, wherein the mass transfer elements in the auxiliary column have an identical or higher specific surface area than those in the low-pressure column.

12. The method as claimed in claim 1, wherein the auxiliary column and the argon discharge column tops condenser are arranged in separate containers.

13. The method as claimed in claim 1, wherein no gas stream and no liquid stream are passed from the low-pressure column into the auxiliary column.

14. A plant for producing oxygen by low-temperature separation of air comprising:

a high-pressure column and a low-pressure column, a main condenser which is a condenser evaporator having a liquefaction space and an evaporation space, wherein the liquefaction space of the main condenser is in fluid communication with the top of the high-pressure column and the evaporation space of the main condenser is in fluid communication with the low-pressure column, an argon discharge column which is in fluid communication with an intermediate point on the low-pressure column, an argon discharge column tops condenser which is a condenser-evaporator having a liquefaction space and an evaporation space, wherein the liquefaction space of the argon discharge column tops condenser is in fluid communication with the top of the argon discharge column, an auxiliary column whose bottom region includes an inlet for introduction of gas from the evaporation space of the argon discharge column tops condenser, and via a crude oxygen conduit for introduction of liquid crude oxygen from the bottom of the high-pressure column into the auxiliary column, a reflux liquid conduit for introducing a liquid stream from the high-pressure column or the main condenser as reflux into the top of the auxiliary column, wherein the liquid stream has a nitrogen content which is at least equal to that of air, and the crude oxygen conduit is configured for introducing crude oxygen into the auxiliary column at a first intermediate point, wherein the auxiliary column is configured to operate at a pressure at the top of the auxiliary column that is at least 50 mbar higher than the pressure at the top of the low-pressure column.

15. The plant as claimed in claim 14, further comprising means for obtaining a gaseous tops fraction from the auxiliary column as a gaseous nitrogen product separately from a gaseous tops nitrogen from the low-pressure column.

16. The plant as claimed in claim 14, further comprising a conduit for introduction of an additional liquid fraction into the auxiliary column at a second intermediate point which is arranged above the first intermediate point.

17. The plant as claimed in claim 14, further comprising means for collecting at least a portion of the liquid downflowing in the auxiliary column immediately above the column bottom and means for introducing the collected liquid into the low-pressure column.

18. The plant as claimed in claim 17, wherein the high-pressure column and the low-pressure column are arranged side by side, the argon discharge column is arranged above the low-pressure column and the auxiliary column is arranged next to the combination of the low-pressure column and the argon discharge column and above the high-pressure column above the main condenser.

* * * * *